United States Patent [19]

Kimura et al.

[11] 3,986,333

[45] Oct. 19, 1976

[54] ELECTRONIC DIGITAL CLOCK

[75] Inventors: Seiji Kimura, Yamatokoriyama; Kenji Sano, Osaka; Nobuo Nakazawa, Kashiwara, all of Japan

[73] Assignee: Sharp Kabushiki Kaisha, Osaka, Japan

[22] Filed: June 14, 1974

[21] Appl. No.: 479,498

Related U.S. Application Data

[63] Continuation of Ser. No. 264,566, June 20, 1972, abandoned.

[30] Foreign Application Priority Data

June 22, 1971 Japan ..... 46-46133

[52] U.S. Cl. ..... 58/38 R; 58/23 R; 58/50 R; 235/92 T

[51] Int. Cl.[2] ..... G04C 3/00; G04C 21/00; G04B 19/30

[58] Field of Search ..... 58/23 R, 38, 50 R; 328/43; 235/165, 176, 92 T, 92 SH; 340/378

[56] References Cited

UNITED STATES PATENTS

| | | | |
|---|---|---|---|
| 3,538,317 | 11/1970 | Fukuda | 235/165 |
| 3,664,116 | 5/1972 | Emerson et al. | 58/50 R |
| 3,788,058 | 1/1974 | Idei | 58/23 R |

*Primary Examiner*—Edith Simmons Jackmon
*Attorney, Agent, or Firm*—Stewart and Kolasch, Ltd.

[57] ABSTRACT

The present disclosure is directed to an electronic digital clock made up of electronic components without using a chain of counters. The digital clock utilizes shift registers with a recirculation path for storing the time information as to hours, minutes and/or seconds and a computing circuit for repeatedly adding the time information one by one in accordance with a predetermined clock base frequency.

13 Claims, 6 Drawing Figures

ELECTRONIC DIGITAL CLOCK

This application is a continuation, of copending application Ser. No. 264,566, filed on June 20, 1972, which is now abandoned.

BACKGROUND OF THE INVENTION

This invention relates to an electronic digital clock device and more particularly to an improved digital clock device wherein the adding circuit and dynamic shift register are combined in order to perform the time-keeping operation and then to provide a digital read-out of the time information.

In the conventional apparatus a crystal oscillator of high-quality is used to obtain a basic time source with a predetermined frequency, e.g. 100 Hz, which in turn is divided into an 1 Hz signal with an appropriate divider unit. The 1 Hz signal is applied to a chain of counters including serially arrayed decimal, hexal, decimal, hexal and duo-decimal counters thereby to carry out the time-keeping operation. The binary-to-decimal decoder then translates the counts of the respective counter stages into the time information with decimal notation, activiating the display tubes in hours, minutes and/or seconds sections to indicate the numeral information as for time. The known clock circuits of the type above-mentioned, however, suffer from various disadvantages. In the first place, the memory circuits for storing the time information require a large number of elements and consequently are very complicated and very voluminous because of necessity of two sets of the hexal and decimal counters and furthermore one duo-decimal counter. For instance, in the case of the hexal counter three flip-flops and a hexal carry circuit are necessary, and similarly in the case of the decimal or duo-decimal counters four-stage cascade-connected flip-flops and a decimal or duo-decimal carry circuit are needed.

In an application to the digital clock respective binary-to-decimal counters are required for each counter, or the serially arrayed hexal, decimal, hexal, decimal and duo-decimal counters. In veiw of the foregoing, it is also unavoidable to increase the required number of elements for the clock device. In addition it is difficult to adapt such counters to integrated circuit technology. To incorporate such a decoder into the equivalent integrated circuit would involve a number of difficulties especially since packages for an integrated circuit are limited in the number of input and output terminals which are available.

On the other hand, the basic functions of the timer unit, or time and alarm settings, necessitate in every instance the provision of another chain of counters identical to the above counter-stages, and the comparision circuit which supplies a set signal when the second counters are equal to the current time. Consequently in the case of the conventional counter system the comparison circuit must be of a multi-stage design since it compares the contents of both chains for every bit position thereof.

OBJECTS AND SUMMARY OF THE INVENTION

Accordingly, the primary object of this invention is to provide an improved electronic digital clock which avoids one or more of the disadvantages and limitations of the above described conventional systems.

Another object of this invention is to provide an improved digital clock which is fabricated with a minimum number of electronic components and is of relatively low cost.

Still another object of this invention is to provide a digital clock which merely needs a single stage decoder to obtain numeral information indicative of the current time in hours, minutes and/or seconds sections.

A further object of this invention is to provide a digital clock which requires only a single stage comparator to compare the current time with time setting.

It is still a further object of this invention to provide a digital clock wherein the electronic sections and components are capable of being fabricated with integrated circuit techniques.

In summary, according to this invention an improved electronic digital clock is provided which, in place of conventional counter chains as above-mentioned employs, dynamic shift registers and an adding circuit to set up the memory circuits for storage of time information. Thus, this invention refers primarily to an improved clock device with comprises means for providing the basic time reference, shift register means of storing and recirculating the time information indicative of the current time and means for repeatedly incrementing or decrementing the time information in response to the basic time reference.

DESCRIPTION OF THE PREFERRED EMBODIMENTS

Figure 1:
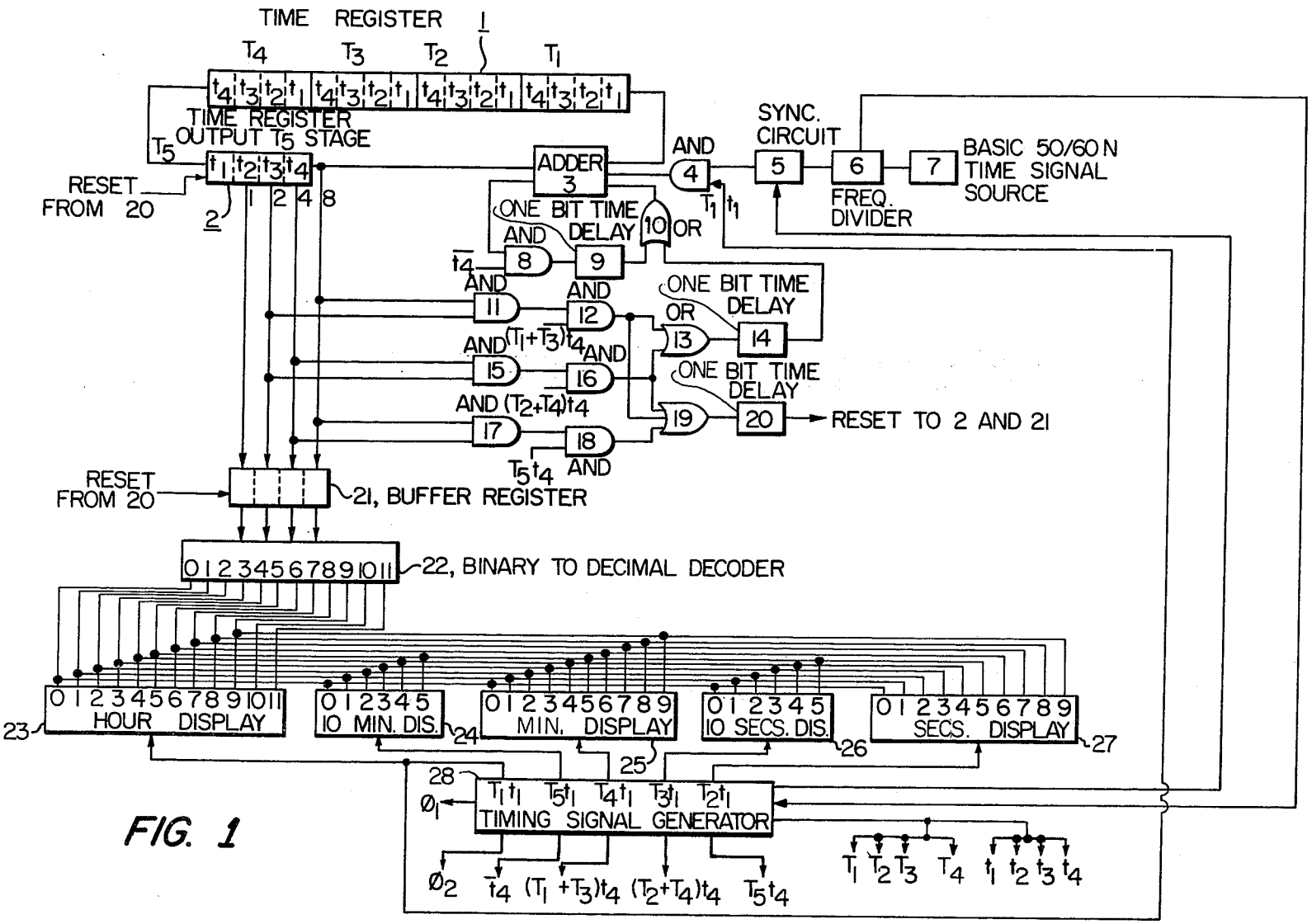
FIG. 1 is a block diagram showing an embodiment of the digital clock in accordance with this invention.

Referring to FIG. 1, a time register 1 is provided including an output stage 2 and forms a memory system, which contains a series of dynamic shift registers for storing N digits, and wherein one digit comprises n bits and N digit time is defined as the time of one word-length. In the embodiment shown in FIG. 1, for example, one digit comprises four bits and the one word-length corresponds to five digit decimal time. Therefore, the least significant digit and the second digit are indicative of seconds section of the time information to be displayed, while the third and fourth digits being indicative of the minutes section. The most significant digit represents the hours section.

Figure 2:
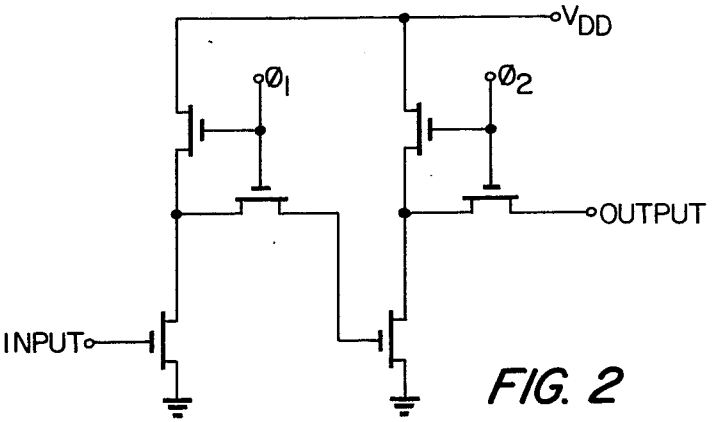
FIG. 2 is a circuit diagram showing a memory unit used in the shift register.

The above-mentioned register unit preferably is constituted by using MOS type field effect transistors which are advantageous for integration of circuits. FIG. 2 is illustrative of a practical circuit configuration of a register unit employed in fabricating the memory unit, wherein a MOS field effect transistor, as known in the conventional art, is utilized as a temporary storage element and transfer gating and loading elements synchronized with clock pulses 0 1 and 0 2. In this register unit, two storage elements having inherent stray capacitances between their gate electrodes and substrate, store electrostatic charges corresponding to information pulses to thereby temporarily record the information.

Figure 3:
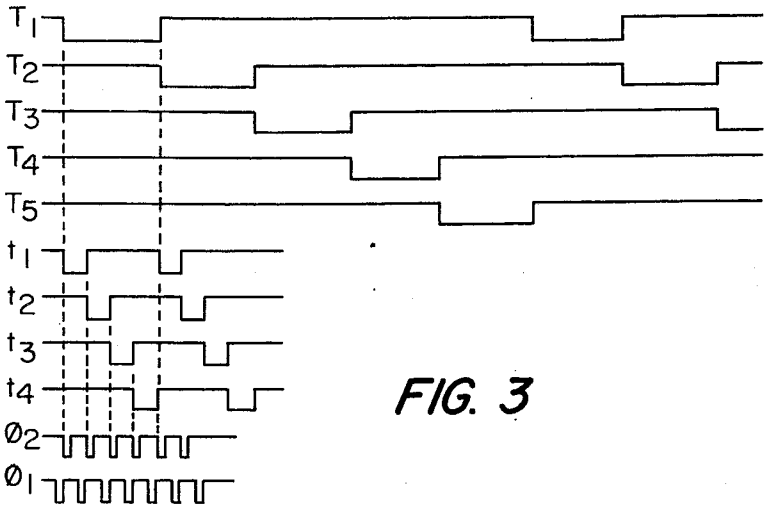
FIG. 3 is a time chart showing the relative phases of various timing signals.

A combination of the main register 1 and output register stage 2 and a pure binary full-adder 3 establishes a recirculation path through which the time information of the five digits in all, i.e. 20 bits, in hours, minutes and seconds sections is dynamically recirculated and stored without losing stored signals. Weighting of the bit and digit outputs from the stage 2 in the recirculation path corresponds respectively to bit time and digit time signals as shown in FIG. 3. In FIG. 3, *t*1, *t*2, *t*3, *t*4 are bit time signals and T1, T2, T3, T4 and T5 are digit time signals. As evident from the figure, the bit time signals are derived in the order of *t*1-*t*2-*t*3-*t*4 and the digit time signals are derived in the order of T1-T2-T3-T4-T5 with the lapse of time. The timing signals are derived from a timing signal generator 28 synchronized with a base power line or crystal oscillator signal source 7.

In the following explanation it is assumed that the bit signals in unit second order are sucessively applied to the adder 3 during the period of the digit time signal T1, ten-second order during the digit time T2, unit minute order during the digit time T3, 10-minute order during the digit time T4 and hour order during the digit time T5.

Figure 4:
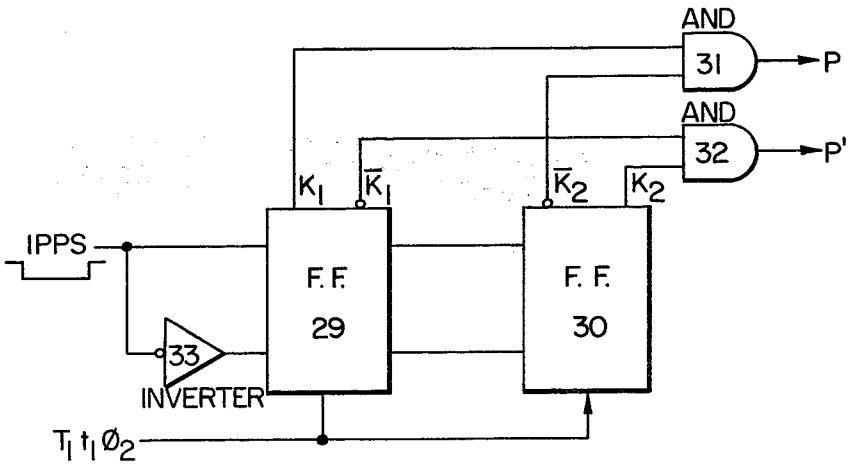
FIG. 4 is a block diagram showing a synchronization circuit used in the FIG. 1 embodiment.
Figure 5:
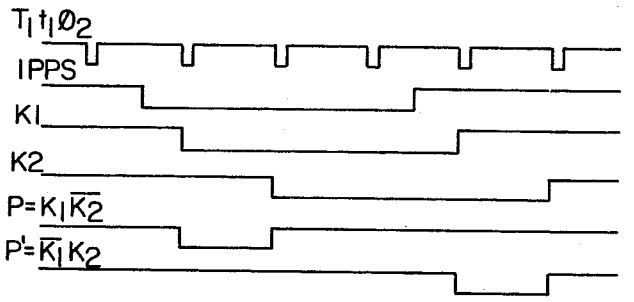
FIG. 5 is a time chart showing the relative phases of various control signals for the purpose of explanation of the synchronization circuit.

The basic time reference, 1Hz signal, is supplied to the full-adder 3 from a suitable source. For instance, the basic time source 7 is the 60/50 Hz powerline or crystal oscillator, which supplies the source signals to a series circuit comprised by a frequency-divider 6, a synchronization circuit 5 and an AND gate 4. The series delivers to the binary adder 3 a time reference signal which occurs one pulse per second and is synchronized with the bit time signals T1t1 as described hereinafter. Assume at this time that the binary adder 3 adds one 1 to the contents of the main register 1 led out during the bit time signal T1t1, or the least significant digit thereof. If a carry is in the results of the addition, the carry output will be applied through an AND gate 8 to an one-bit time delay circuit 9, which in turn feeds it back through an OR gate 10 to the binary adder 3 during the next bit time T1t2. In such a way the propagation of a carry to the next higher decimal order is accomplished by adding one to the register contents led out during the next bit time T1t2. Similarly, when the carry propagation results in a further carry signal, the adder 3 is energized to add one to the contents led out during the next bit time of T1t3 thereby to provide the carry operation. Next, the synchronization circuit 5 will be described with reference to FIGS. 4 and 5. It consists of two flip-flops 29 and 30, two AND gates 31, 32 and an inverter 33. Both flip-flops 29, 30 receive as their timing signals the signals T1t102 shown in FIG. 4 as well as the basic 1 pps time reference signals in phase relation and then deliver as their output signals K1K2 and K1K2 to the AND gates 31, 32 respectively, which in turn make the outputs P, P′ synchronized with the timing signals T1t102.

The numeral information stored in the main register 1 is fed into the output section 2 through the binary adder 3 and further one stored in the output section 2 is fed back to the main register 1 whereby the binary-coded information as for time recirculates through the path. It should be noted that each piece of the coded information in hours, minutes and seconds sections recirculates together through the same path serially. The change in time information being recirculated in the main shift register due to successive additions by the adder 3 is fed from the output stage 2 of the main shift register 1 to a buffer register 21 in seconds order during the period of the digit time T1, ten seconds order time during the period of T2, minutes order during T3, ten minutes order during T4, and hours order during T5, respectively. Thus, during each recirculation period, the time information of any one digit (four bits) is transferred from the output stage 2 to an indicating buffer register 21 in synchronization with an appropriate timing pulse. The transferred information of one digit is introduced into the binary-to-decimal decoder 22, which judges the decimal number of 0 to 11. Recall that the time information is being recirculated through the main shift register 1 in synchronization with the high frequency clock pulses 01, 02 so that at least one complete recirculation of the contents of the shift register occurs during each second. If desired, even higher recirculation rates can be used and, in fact, are required with the embodiment of the invention to be described with relation to FIG. 6.

Each output of the decoder 22 which corresponds with the seconds, 10 seconds, minutes, 10 minutes and hours information being recirculated in the shift register 1, is supplied in order with the lapse of time and in synchronization with the appropriate T1t1, T2t1, T3t1, T4t1, T5t1 timing signals to the seconds display tube 27, the 10 seconds tube 26, the minutes tube 25, the ten minutes tube 24 and the hours tube 23 respectively. Hence, each display tube 27, 26, 25, 24, 23 receives the synchronizing signals T1t1, T2t1, T3t1, T4t1, T5,t1 and thus is energized only when the predetermined timing signals and the decoded input signals are coincided in time with each other. That is to say, the display system is driven by means of time-division. It is also noted that the total of five digits is processed by a single decoder and a single number selector common to all the display tubes, and is much different from the conventional method.

For instance, in the case that the contents of the output stage 2 are <0011> during the period of T5t4; the contents of the buffer 21 being <0011> during the period of the following bit time T1t1, the hours tube 23 is only activated to indicate the decimal numeral 3 corresponding to the binary number 0011. After that, if the contents of the buffer 21 are <0001> during the succeeding bit time T2t1, only the seconds tube 27 glows to indicate the numeral 1. Similarly, when the contents during the bit time signals, T3t1, T4t1 T5t1 are respectively <0101>, <0111> and <0100>, the tubes 26, 25, 24 are allowed to indicate the numerals 5, 7 and 4. The visible indication is held due to the persistance of the image on the retina and the activation inertia of the display tubes, because that the contents <0011>, <0001>, <0101>, <0111> and <0100> are not varied until the digit led out during the bit time T1t1 in incremented by one. In this case the clock shows the current time of 3, 47′, 51″. The time-keeping operation in the binary adder 3 is carried out in the following manner. As already explained, the digit led out during the time interval of T1, i.e. the first bit in the least significant digit, in successively incremented one by one in response to the time reference 1pps fed through the AND gate 4. If the digit led out when T1 occurs and buffer register 21 has <1010>, the AND gate 11 is in its open state and the AND gate 12 is also opened by the timing signals (T1+T3)t4, so that the time information in the first digit place is applied through OR gates 13, 19 to one-bit time delay circuits 14, 20. It follows, therefore, that the time information is supplied to the binary adder 3 through the OR gate 10 with the delay of one-bit time and accordingly the addition of one is given effect only to the second digit led out during the bit time T2t1. Contrarily, the signals from the delay circuit 20 are simultaneously applied as reset signals to the output stage 2 and the buffer register 21, resetting the least significant digit previously stored in the output stage 2 and the buffer register 21 to <0000>.

In this mode, at every lapse of ten seconds; the first digit becoming <1010> at the time T1t4, the output stage 2 and the buffer register 21 are reset to <0000> and at the same time the second digit is repeatedly increased by one in the binary adder 3. As a result, the carry propagation to the higher order to accomplished.

Thereafter, when the second order digit becomes <0110> at the timing T2t4, the bit signals in the second digit from the gates 15, 16 enter into both the one-bit delay circuit 14, 20. After the time lapse of one-bit, only the bit signal taken out during the time T3t1 is added by one in the adder 3 upon the presence of the delayed signals, while the registers 2, 21 are again reset to <0000> due to the delayed signals. Therefore, whenever the second digit signals are reached by <0110> at the bit time T2t4, the third digit signals in the minutes section is incremented by one and the coded contents in the ten seconds section being reset to <0000>.

In the same way as the above, if the third order digit in the minutes section takes coded contents of <1010> at the time T3t4, the AND gates 11, 12 are allowed to be open with the results that the carry signal propagates to the fourth digit (the ten minutes section) and the third digit signals take a code chain of <0000>. With the time lapse of ten minutes the forth digit increases one by one.

How, in the case where the fourth digit contents are <0110>, the AND gates 15, 16 are again turned to their ON conditions, following by that the carry signal operation to the fifth digit in hours section is carried out with resetting the ten minutes section to the all-zero state.

Finally, if the most significant digit in the hours section becomes <1100> at the bit time T5t4, the AND gates 17, 18 will be active and the delay circuit 20 will receive the bit signals from the output 2 through the OR gate 19. The delay circuit 20 will reset the output and buffer registers 2, 21 to <0000> after the delay of one-bit time. In the embodiment herein described, the binary-coded information in the hours, minutes and seconds sections dynamically recirculates through the shift register 1 and the binary adder 3, and simultaneously the time-keeping operation is accomplished by adding one to the least significant digit with the carry propagation. At any time display tubes show the current time in hours, minutes and seconds sections. although in the above-mentioned description the time information in hours section is displayed by only one tube 23, the hours section may be divided into two parts by the use of two display tube and additional four-bit memory unit to the main register 1. If necessary, one tenth order and/or one hundredths order of seconds, may be indicated merely by adding the further memory unit to the main register 1.

In the event of the wrong time; when the indicating time of the clock device is considerably different from the correct time, in stead of the timing signals T1t1 normally applied, the timing signals T5t1 are applied to the AND gate 4 to correct the hours section, and then the timing signals T3t1 are applied to correct the minutes section.

Figure 6:
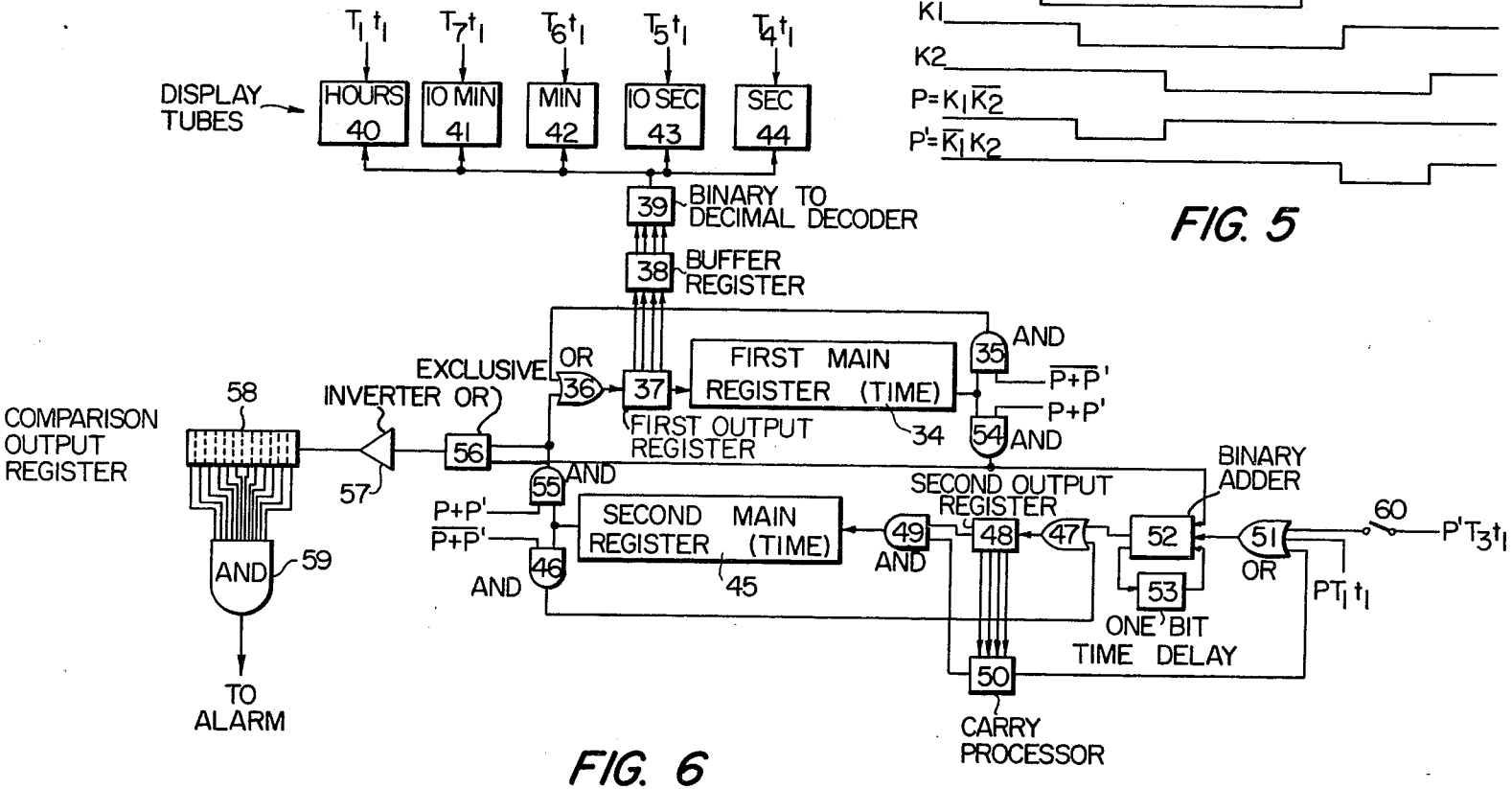
FIG. 6 is a block diagram showing embodiment of the digital clock in accordance with this invention.

Now referring to FIG. 6, consideration is made about the timer operation, or the setting and alarm setting. The embodiment of FIG. 6 includes the first main shift register 34 and the second main shift register 45, each consisting of a series of dynamic shift registers synchronous with two clock pulses 01, 02 for storing six digits, i.e. 24 bits. The first and second output register 37, 48 also consist of dynamic shift registers of one-digit capacity.

A chain of the first main register 34 and the first output register 37 forms the first recirculation path as well as AND and OR gates 35, 36, and similarly their counterparts 45, 48 establishes the second recirculation path as well as two AND gates 46, 49 and an OR gate 47. The current time information in the hours, minutes and seconds recirculates through one of the paths, whereas the timer information recirculates through the other. In the case of the timer setting it is normally sufficient to store the information in the hours, minutes order. Thus, in the following the digits in any order less than minutes are represented by <0000> for the purpose of explanation. If desired it is possible to effect time settings of the order of one hundredth of a second, for example.

Two AND gates 54, 55 and the pure binay full-adder 52 couple one of the recirculation path to the other, thereby allowing two kinds of the information to be exchanged therewith at every predetermined timing. During the exchange process the predetermined information is added one by one in the binary adder 52.

In the first recirculation chain the current time or timer inforamtion of 28 bits is successively advanced in synchronization with the clock pulses 01, 02 and then the bit signals led out from the register 34 are fed back through the AND and OR gate 35, 36 to the output register 37. Another type of information different from one in the first path is also shifted bit by bit in response to the clock pulses 01, 02.

As a matter of convenience it is assumed that the information is one hundredths seconds order in fed from the main register 34, 45 into the output register 37, 48 during the period of the digit time T1, one tenth seconds order during the period of T2, seconds order during T3, tens seconds order during T4, minutes order during T5, tens minutes order during T6, and hours order during T7.

The time information and the timer information individually recirculates through the respective recirculation path. In particular upon the appearance of the timing pulse P or P′ the AND gates 35, 46 are closed and the AND gates 54, 55 are opened, so that the information stored in the first recirculation path is transmitted into the other path through the AND gate 54 whereas another information in the second path is transmitted into the first path through the AND gate 55.

The pulse weight of the timing pulses P and P′ is so chosen as to be equal to the total of seven digit time period T1-T7, one-word time, Thus, while the transmission of the one-word information (the current time or timer information) is completed, the AND gates 54, 55 remain open and the AND gates 35, 46 close, and during the next one-word time the gates 54, 55 are in closed conditions and the gates 35, 46 is opened conditions. Upon every application of the timing pulse P or P′ one kind of the information alternates with another kind in the same path. In order to produce the timing pulses P, P′ having a frequency higher than the timing pulses previously described with relation to FIGS. 4 and 5, another reference 100pps is applied as a source of input signals to the synchronization circuit shown in FIG. 4 in place of the time reference 1pps. As a results of the application of the reference 100pps the AND gates 31, 32 deliver to the AND gates 46, 55, 35, 54 the signals P, P′ which are synchronized with the timing signal T1t102 and have the same pulse width as the signal T1t102. During the pulse width of the timing pulse P the current time information is transmitted from the first path to the second one through the AND gate 54 and the adder 52 and during the pulse P′ the timer information is transmitted from the first path to the second one.

The time keeping function in the FIG. 6 embodiment will be better understood after a reading of the following description. When the first bit signal T1t1 in the time information in the first recirculation path is supplied to the adder 52 at the timing T1t1 out of the P cycle, the adder 52 receives the addition instruction through the OR gate 51 as well as the least significant bit signal thereby adding one to the least significant bit. The addition to the least significant bit is carried out at every timing signal T1t1. If the carry output occurs in the addition process, it will be fed back to the adder 52 with one-bit time delay by means of the delay circuit 53 at the next bit time T1t2, following by the carry propagation to the second bit signal in the least significant digit. Similarly, in the case that the adding input again appears in the adder 52 as a results of the repeatedly propagation of the carry signals, the carry signals is so fed back to the adder 52 through the delay circuit 53 at the next higher bit time T1t3 as to advance to the next higher order in the time information.

Whenever the time information is alternatively transmitted from one of the paths to the other; at every lapse of the period corresponding pulse width of the time basic reference 100pps (100Hz signal), the addition repeatedly affects the first bit of the least significant digit order of the time information. Consequently, when the contents of the least significant digit become <1010>, the coded signals from the second output register 48 actuate the carry processor 50, which in turn resets the coded signals to <0000> through the AND gate 49 and supplied the decimal carry signal through the OR gate 51 to the adder 52 thereby to propagate the decimal carry to the second digit signal.

After that, if the contents of the second digit reach <0110>, the operation of the carry processor 50 results in resetting the contents of the second digit place to <0000> and advancing the hexal carry signal forward the third digit. Thus, the carry propagation to the third digit is accomplished every second.

In addition, when the coded contents of the third digit in the seconds section are <1010> the fourth digit position receives the decimal carry signal, and when the fourth digit has the contents of <0110> the hexal carry operation becomes effective to the fifth digit signal every 1 minute. In the same way the coded contents <1010> of the fifth results in the decimal carry operation to the next higher order digit, and furthermore <0110> of the sixth digit results in the hexal carry operation every one hour. Lastly, immediately after the seventh digit signals become <1100>, the seventh digits are reset to <0000>.

During the time-keeping operation as already explained the time information recirculates through the first path and then each digit signal is taken out from the first output register 37 and supplied through the buffer register 38 to the binary-to-decimal decoder 39. It translates each digit signal into one decimal number of 0 to 11 and the decoded signals are respectively supplied to the display tubes 40, 41, 42, 43, 44 for hours, tens of minutes, minutes, tens of seconds and seconds. On the other hand the predetermined timing pulses are respectively applied to the display tubes 40 through 44.

The display tubes 40 through 44 normally provide digital read-out of the current time. However, when the timer information recirculates through the first recirculation path, the timer information may be voluntarily displayed in the same tubes by an appropriate switch.

One recirculation path shows the current time information while the second recirculation path stores the time set information previously introduced. In order to set the timer information to a desired initial state, the switch 60, is closed. The information then stored in the second path during the timing pulse P′ is modified by the application of the timing signal P′T3t1 to the binary adder 52. As a result of the application of timing signal P′T3t1 the information in the second path is rapidly incremented one by one at a rate of 100Hz and displayed in the tubes. The desired time setting may be achieved by closing the switch 60 at an appropriate time.

As noted hereinbefore, the FIG. 6 embodiment is so arranged and constructed that the present time information varying every moment and the timer information previously introduced recirculate respectively through either of the recirculation paths and exchanges repeatedly their positions therewith at the appropriate time. For the purposes of comparison of the current time with the timer setting, outputs from the AND gates 54, 55 are supplied to an exclusive-OR gate 56 during the period of P or P′, and the output from the exclusive OR gate 56 is transferred through an inverter 57 into the comparison output register 58. The comparison is done at every bit signal except one less than minutes order and its outputs are successively stored in the register 58. Upon any one bit signal of the time varying information coinciding with its counterpart in the preset timer information, the output of the inverter 57 becomes 1. Otherwise, when both are different the inverter output is 0. Upon all the time varying digits more than second order coinciding with the preset timer digits then, all the stages of the register 58 becomes 1 thereby opening the AND gate 59 to energize an alarm buzzer, chime, or radio.

We claim:

1. A clock device comprising:

means for providing a basic time reference electric signal at a fixed rate; shift register means for storing and recirculating a plurality of binary bits representative of time information indictive of the current time; and means for repeatedly modifying the plurality of binary bits representative of the time informatiom in response to the basic time reference electric signal.

2. A clock device comprising:

means for providing a basic time reference electric signal at a fixed rate; recirculation path means comprising a dynamic shift register for storing a plurality of binary bits representative of a multi-digit indication of the current time; means for adding one binary bit to the stored multi-digit indication of the current time in response to the basic time reference electric signal; means for making a carry signal in the results of the addition of a predetermined digit effective to a higher digit; and means for displaying the time information represented by the multi-digit indication stored in the recirculation path means.

3. A clock device according to claim 14, wherein the shift register means comprises a chain of dynamic shift registers having a recirculation path between its input and output terminals.

4. A clock device according to claim 3, wherein the dynamic shift register units include a plurality of field effect transistors for temporarily storing signals applied thereto.

5. A clock device according to claim 2, wherein the adding means receives and adds the predetermined multi-digit binary indicative of current time information and the basic time reference electric signal to carry out the time-keeping operation.

6. A clock device comprising:

means for generating a basic time reference electric signal every second; recirculation path means including a dynamic shift register for storing a plurality of binary coded, multi-digit electric states representative of current time in hours, tens of minutes, minutes, tens of seconds and seconds sections; means for adding one binary bit to the digit representative of the time information in the seconds section every second; means for respectively propagating a decimal carry to the digit in the tens of seconds section, a hexal carry to the digit in the minutes section, a decimal carry to the digit in the tens of minutes section and a hexal carry to the digit in the hours section; means for resetting the time information stored in the recirculation path means in the case of the presence of a carry from the hours section; means for translating the time information within the recirculation means into decimal numbers; and means for dynamically displaying the translated numbers in hours, tens of minutes, minutes, tens of seconds and seconds sections.

7. A clock device comprising:

means for generating a basic time reference electric signal every second; recirculation path means including a dynamic shift register for storing a plurality of binary-coded, multi-digit electric states representative of current time in tens of hours, hours, tens of minutes, minutes, tens of seconds and seconds sections; means for adding one binary bit to the digit representative of the time information in the seconds section every second; means for respectively propagating a decimal carry to the digit in the tens of seconds section, a hexal carry to the digit in the minutes section, a decimal carry to the digit in the tens of minutes section, a hexal carry to the digit in the hours section and a decimal carry to the digit in the tens of hours section; means for resetting the time information stored in the recirculation path means in the case of the presence of a carry from the tens of hours section; means for translating the time information within the recirculating means into decimal members; and means for dynamically displaying the translated numbers in tens of hours, hours, tens of minutes, minutes, tens of seconds and seconds sections.

8. A clock device according to claim 5, wherein advance signals are supplied to the adding means at a rate more rapid that the basic time reference electric signal applied thereto.

9. A clock device comprising:

means for providing a basic time reference electric signal at a fixed rate; first recirculation path means including a first dynamic shift register for storing a plurality of binary bits representative of a multi-digit indication of the current time; second recirculaltion path means including a second dynamic shift register for storing a corresponding plurality of bits representative of a multi-digit indication of a previously introduced time setting; means for adding one binary bit to at least the current time information multi-digit representation in response to the basic time reference electric signal; and means for displaying at least one kind of information taken out from either of the recirculation path means.

10. A clock device according to claim 9, wherein the two kinds of information are repectively the current time information varying at least every second and the previously introduced time setting.

11. A clock device according to claim 9, further including means for exchanging the contents in the first recirculation path with the contents in the second recirculation path.

12. A clock device according to claim 10, further including means for comparing the current time information indication with the previously introduced time setting and alarm means energized by the output of the comparing means upon the current time reaching the previously introduced time setting of the second dynamic shift register.

13. A clock device according to claim 10, wherein the displaying means indicates the time setting information previously introduced instead of the current time information.

* * * * *